US005301802A

United States Patent [19]

Nemeroff

[11] Patent Number: 5,301,802

[45] Date of Patent: Apr. 12, 1994

[54] INIVIDUAL DRINKING CUPS

[76] Inventor: Allan Nemeroff, 681 Longview Dr., Huntington Valley, Pa. 19006

[21] Appl. No.: 101,530

[22] Filed: Aug. 3, 1993

[51] Int. Cl.[5] ..... B65B 5/00; G09F 19/00

[52] U.S. Cl. ..... 206/217; 206/459.5; 206/499; 40/324

[58] Field of Search ..... 206/459.5, 534, 217, 206/499, 515; 220/703; 40/324, 366, 638

[56] References Cited

U.S. PATENT DOCUMENTS

| | | | |
|---|---|---|---|
| 496,131 | 4/1893 | Peirce . | |
| 1,770,118 | 7/1930 | Williams | 206/217 |
| 2,162,629 | 6/1939 | McBride | 40/324 |
| 2,804,236 | 8/1957 | Plazze | 206/806 |
| 2,818,168 | 12/1957 | Tobey et al. | 206/447 |
| 2,861,717 | 11/1958 | Vines | 221/307 |
| 2,908,985 | 10/1959 | Hartman | 40/2 |
| 3,182,791 | 5/1965 | Jenner | 206/459 |
| 3,306,437 | 2/1967 | Nelson | 206/459 |
| 3,514,887 | 6/1970 | Jacobs | 40/324 |
| 3,574,957 | 4/1971 | Bello-Bridick | 35/76 |
| 3,612,321 | 10/1971 | Larson | 128/760 |
| 3,627,858 | 12/1971 | Parts et al. | 40/324 |
| 3,827,620 | 8/1974 | Ludder | 206/459 |
| 3,908,877 | 9/1975 | Kosisky | 206/459 |
| 4,114,605 | 9/1978 | McGhee et al., | 128/760 |
| 4,171,085 | 10/1979 | Doty | 229/1.5 |
| 4,235,459 | 11/1980 | Callahan | 283/7 |
| 4,287,824 | 9/1981 | Boyle | 101/172 |
| 4,518,639 | 5/1985 | Phillips | 206/459 |
| 4,573,954 | 3/1986 | Berger et al. | 400/103 |
| 4,592,884 | 6/1986 | Thomson | 206/534 X |
| 4,964,512 | 10/1990 | Ingram et al. | 206/459.5 |
| 5,147,043 | 9/1992 | Gould | 206/459.5 |
| 5,191,979 | 3/1993 | Nemeroff | 206/459.5 |

*Primary Examiner*—Paul T. Sewell
*Assistant Examiner*—Jacob K. Ackun, Jr.
*Attorney, Agent, or Firm*—Kenyon & Kenyon

[57] ABSTRACT

A set of drinking cups is provided with individual identifying indicia, which serve to distinguish one cup of the set from another, and a matching set of labels with corresponding indicia, which are used to help cup users to find their own cups.

4 Claims, 2 Drawing Sheets

INIVIDUAL DRINKING CUPS

BACKGROUND OF THE INVENTION

This invention relates to apparatus of individualized drinking cups to distinguish the cup of one user from that of another with the help of a unique indicia on a cup and a separate label with a matching indicia. This is particularly useful for two classes of users. One class consists of children who can't read. The other consists of elderly persons who tend to be forgetful.

Disposable drinking cups are extremely popular for the convenience they offer in situations in which large number of people are served. As is well known, disposable cups are offered by manufacturers in plastic or paper, and may be had in plain, unadorned form, in colors, or with decorative designs. Cups are typically purchased in bulk, and in the usual case, all of the cups in a given package are similar, if not identical, in appearance. This leads to situations in which the drinks of individual users, when put down momentarily, cannot be distinguished from one another. Consequently, an individual often cannot identify his own drink and is faced with the choice of drinking from a cup which may have been used by another, or abandoning what may indeed be his own drink.

Where confusion occurs of one drink for another, the results are unsanitary, and potentially injurious to health. On the other hand, when one unnecessarily abandons a cup because it cannot be positively identified, the result is wasteful, and uneconomical. Such waste is also ecologically injurious when the cups are made from non biodegradable materials such as plastic.

In U.S. Pat. No. 3,908,877, to Kosisky, it was proposed to provide a circular tray having circumferentially spaced openings, marked with the names of individual users. Cups, also bearing the names of individual users, are associated with the openings. Such an arrangement permits the identification of cups and drinks, but in order for the disclosed technique to work, the cups must be returned to the tray. It has a further disadvantage of a need for prior identification of all individual users. Still another disadvantage is that the number of users it can accommodate is limited to the number of openings in the tray.

A drinking cup apparatus in U.S. Pat. No. 5,191,979, to Nemeroff, overcame many of the limitations of the Kosisky patent. There, it was proposed to provide a stack of cups, each bearing a unique indicia which differentiates that cup from the others thereby eliminating the need for prior identification. It further solved the problem of confusion as between drinks of large number of people at an event.

However, there is a deficiency in such an apparatus in that a user may well forget which identifying indicia was placed on his cup. It is the object of the present invention to provide for a separate set of labels bearing identifying indicia with the indicia on each label corresponding to a matching indicia on each cup. Thus, even if a user forgets the indicia on his cup, he can easily remind himself of it by looking at the matching indicia on the label. The labels will usually have adhesive backings but need not have for this apparatus to work. Accordingly, a label without an adhesive backing can be placed in his pocket, or with such backing, placed on his hand, clothing, or on other suitable locations.

Another object of the invention is to provide a teaching tool for children learning numbers, letters or symbols, or for persons with learning disabilities. This can be accomplished, for example, by having a child place a label on his hand and asking him to match the indicia on the label to a cup with a corresponding indicia.

SUMMARY OF THE INVENTION

The foregoing and other objects of the invention are achieved, in a presently preferred form of the apparatus, by providing at the point of sale a stack of cups, each bearing a unique indicia and a separate label bearing a matching indicia which differentiates that cup from the others. In one preferred form of the invention, the indicia on the cups and the labels may be a sequence of numbers, whereby individual users are provided with numbers different from those of any other users.

There are seen in the drawings, forms of the invention which are presently preferred. But it should be understood that the invention is not limited to the precise arrangements and instrumentalities shown or described herein.

DETAILED DESCRIPTION

Figure 1:
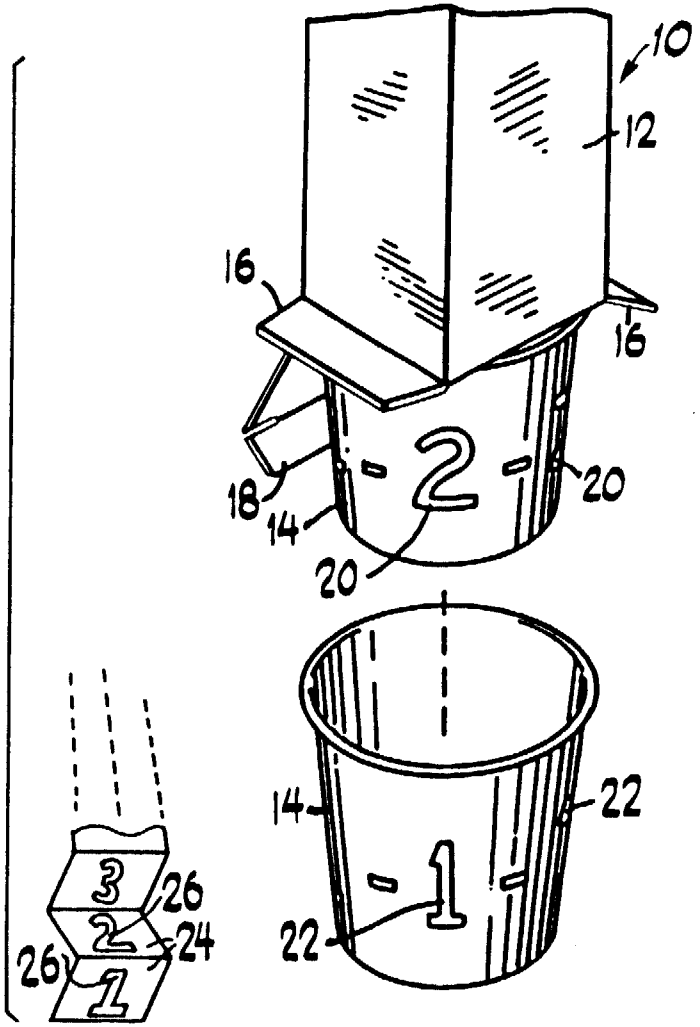
FIG. 1 is a perspective view of one preferred arrangement, showing two cups in a numbered sequence, as they would be removed in accordance with this invention from a container in which they are stored or sold, and a set of separate labels with matching numbers disposed thereon.

Referring now to the drawings in detail, wherein like reference numerals indicate like elements, there is seen in FIG. 1 apparatus designated generally by the reference numeral 10.

The apparatus 10 comprises a container 12, a stacked set or series of drinking cups 14, and a set of adhesive labels 24. The container 12 may be a conventional four-sided cardboard box, or any other rigid or flexible or elongated sleeve-like structure. The drinking cups 14, nested within each other, are received in the container 12, and may be removed from the container 12 upon opening of one of its ends.

End flaps 16 and 18 provide a closure for the end of the illustrated container 10.

The cups 14 carry individual identifying indicia, such as, in FIG. 1, numerical indicia 20 and 22. The indicia may appear on the cups at any desired number of times or places.

The indicia 20 and 22 are exemplary of other kinds of indicia which may be applied to the cups 14 supplied in the container 12. Where numerical indicia are used, the indicia for the respective cups are ideally and preferably a sequential series (i.e., "1, 2, 3, etc."), without repetition. Thus, each of the cups 14 has its own unique indicia which serves to distinguish it from every other cup 14 in the container 12.

The set of separate adhesive labels 24 with indicia 26 that correspond to the unique indicia on the cups 14 is shown as a series of peel-offs which can be applied, for example, on users' hands, clothing, or on other suitable locations. Thus, it should be apparent that a user need not remember nor make a mental note of the indicia on his cup in order to identify it. Again, however, the labels need not have adhesive backings for this apparatus to work.

In conventional practice, the cups 14 are made of either paper-like material, such as cardboard, or plastic. When the cups are of paper-like material, the indicia 20, 22, etc. may be printed on the cups during their manufacture. When the cups are plastic, the indicia 20, 22, etc. may advantageously be defined by roughened or etched areas, which stand out in visual contrast to non-affected material surrounding them.

Figure 2:
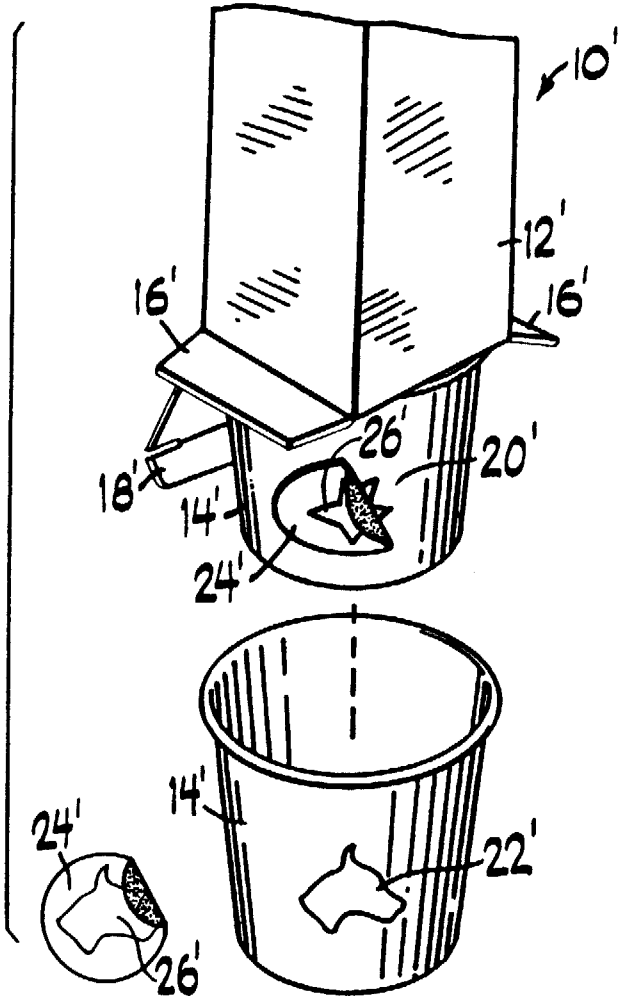
FIG. 2 is a perspective view, similar to FIG. 1, showing another preferred arrangement whereby an adhesively backed label with an identifying indicia, in this case, a pictorial symbol, is partially peeled off to show a matching symbol on the cup.

Referring now to FIG. 2, there is seen an alternative form of the invention in which elements corresponding to those previously described are designated by like, primed (') reference numerals. Referring to FIG. 2, the cups 14' have applied to them, by printing or other suitable means, identifying indicia 20', 22', etc. In the case of the cups 14' shown in FIG. 2, the indicia, rather than being numerical, are pictorial representations of recognizable objects or designs. Again, however, the design associated with each individual cup 14' is unique, so that each cup 14' in a given set can be distinguished from the others.

Unlike the separate set of peel-off labels provided in the previously described form of the invention, the embodiment in FIG. 2 shows adhesive labels 24' applied on the cups 20' which can then be peeled off for application thereby lessening the chance for misplacing the matching labels.

Referring to a cup 14' partially inside the container 10' in FIG. 2, it shows an adhesive label 24, with an indicia 26' disposed thereon, applied directly over the matching indicia 20'. The label 24' is shown partially peeled off to reveal the matching indicia 20' beneath it. In the case of the other cup 14' outside of the container 10', the adhesive label 24' has been fully peeled off, ready for application on a user's hand, clothing or other suitable places.

Figure 3:
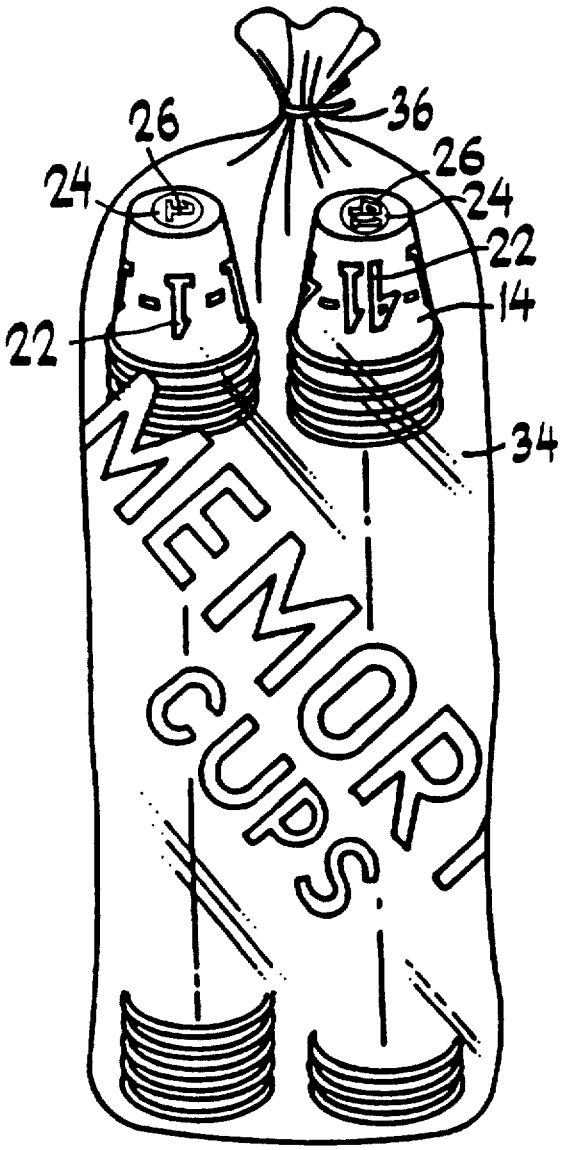
FIG. 3 illustrates one presently preferred form of packaging, in which numbered cups are provided in stacked form in a transparent and flexible plastic sleeve along with a set of adhesive labels with matching numbers disposed thereon, which are placed on the bottom of the cups.

Referring to FIG. 3 now, similar to the above described embodiment, it also shows adhesive labels applied on the bottom of the cups 14. In FIG. 3, cups, such as the cups 14 or others, may be sold in stacks, in a container such as a transparent flexible sleeve-like bag 34 or the like. The bag 34 may conventionally be provided with a tie 36. As is the case of the above-described packaging, the cups may be removed from the bag 34 in sequence, and may readily be identified for reuse by the indicia they bear.

It should be understood that the present invention may be embodied in other specific forms without departing from its spirit or essential attributes. Accordingly, reference should be made to the appended claims, rather than the foregoing specification, for an indication of the scope of the invention.

What is claimed is:

1. A drinking cup identification apparatus comprising
a container,
a set of drinking cups comprising
a plurality of cups nestably received in said container and removable therefrom,
individual identifying first indicia associated with each of said cups so as to facilitate visual discrimination of one cup from the others of said set, said first indicia including
a visually discernable identifying symbol disposed on each of said cups, each identifying symbol on a cup being different from the symbols of the other cups in said set so as to distinguish the cups in said set from one another, and
a matching set of a plurality of labels for said first indicia, said labels including
a second indicia disposed thereon with one second indicia corresponding to one first indicia, any of said second indicia disposed on one label of said plurality of labels being different from any of said second indicia disposed on all other labels of said set, said labels for associating each said cup with a corresponding cup user.

2. The drinking cup identification apparatus of claim 1, wherein said set of a plurality of labels is disposed in said container.

3. The drinking cup identification apparatus of claim 1, wherein each label with said second indicia is affixed to each cup with a matching first indicia, said label being easily removable from said cup.

4. The drinking, cup identification apparatus of claim 3, wherein each said label includes an adhesive backing, which can be applied on a cup user's hand, clothing, or on other suitable locations.

* * * * *